US006471055B1

(12) United States Patent
Kwiecienski

(10) Patent No.: US 6,471,055 B1
(45) Date of Patent: Oct. 29, 2002

(54) LIGHT-IN-WEIGHT GOLF CLUB HOLDER

(76) Inventor: Richard E. Kwiecienski, 10 Fig Ct. W., Homosassa, FL (US) 34446

( * ) Notice: Subject to any disclaimer, the term of this patent is extended or adjusted under 35 U.S.C. 154(b) by 0 days.

(21) Appl. No.: 10/063,925

(22) Filed: May 24, 2002

Related U.S. Application Data

(63) Continuation-in-part of application No. 09/681,750, filed on May 31, 2001.

(51) Int. Cl.[7] ..... A63B 55/04

(52) U.S. Cl. ..... 206/315.7; 206/315.2; 248/96; 211/70.2

(58) Field of Search ..... 206/315.7, 315.2, 206/315.3; 248/96; 211/70.2

(56) References Cited

U.S. PATENT DOCUMENTS 1,408,876 A * 3/1922 Frey ..... 206/315.7 X
1,471,766 A * 10/1923 Wolfe ..... 206/315.7 X
1,696,062 A * 12/1928 Thurlow et al. ..... 206/315.2 X
2,091,298 A * 8/1937 Agnew ..... 206/315.7 X
2,408,777 A * 10/1946 Holbrook ..... 206/315.7 X
2,482,372 A * 9/1949 Rossow ..... 211/70.2
2,570,504 A * 10/1951 Van House ..... 211/70.2
2,571,088 A * 10/1951 Walton ..... 206/315.7 X
3,455,358 A * 7/1969 Kuzma ..... 206/315.7 X
3,787,017 A * 1/1974 Sauer ..... 206/315.7 X
4,054,256 A * 10/1977 Buck, Jr. et al. ..... 248/96
5,573,122 A * 11/1996 Williams ..... 211/70.2
6,311,938 B1 * 11/2001 Lin ..... 248/96

* cited by examiner

*Primary Examiner*—Lee Young
*Assistant Examiner*—Tri M. Mai
(74) *Attorney, Agent, or Firm*—Ronald E. Smith; Smith & Hopen, P.A.

(57) ABSTRACT

A golf club carrier includes a central support that forms one of three legs that support the carrier when in use. The two other legs are provided by bending a flexible and resilient rod at its mid-point and pivotally interconnecting the rod at that mid-point to an upper end of the central support. Three point stability is provided when the legs are pivoted relative to the central support. A detent member mounted to the central support captures the legs to position them in a storage position. The inherent bias of the rod urges the legs to resume a divergent relation to one another when they are released from the detent member. A top ring and a cup are secured to a first side of the central support and support at least seven clubs. Auxiliary devices are mounted to a second side of the central support to avoid interference.

16 Claims, 4 Drawing Sheets

LIGHT-IN-WEIGHT GOLF CLUB HOLDER

BACKGROUND OF INVENTION

1. Field of the Invention

This invention relates, generally, to devices for carrying golf clubs. More particularly, it relates to a light-in-weight golf club-carrying device that minimizes materials and substantially reduces its weight relative to conventional golf bags.

2. Description of the Prior Art

Conventional golf bags can hold many clubs but the bags are heavy and bulky. Most golfers do not care about the weight and bulk of conventional golf bags, however, because they ride in golf carts between holes.

Those who walk the course best enjoy the health benefits of golf, however. For those golfers, the conventional golf bag is too heavy. Most golfers seldom use all of the clubs in the bag, so the effort required to carry a conventional bag is wasted. Instead, most golfers have five or six or possibly seven favorite clubs that they use frequently to the substantial exclusion of other clubs.

What is needed, then, is a light-in-weight device for carrying five to seven golf clubs. The needed device should weigh as little as possible to encourage more golfers to walk during the game.

Golf bags of conventional construction fall over easily. Ground-penetrating spikes attachable to golf bags have been developed, but spikes are difficult or impossible to drive into the ground in hard pan and rocky terrain. Moreover, spikes don't hold well in uneven, soft, sandy, or wet terrain.

Therefore, there exists a need for a golf club carrier that is supported in such a way that it may be positioned in substantially upstanding position in all soil conditions and on uneven terrain.

Moreover, heavy golf club bags of conventional construction can damage a green. Thus, there is a need for a golf club carrying device that is light-in-weight so that it may be placed on a green without marking or damaging the green.

However, in view of the prior art considered as a whole at the time the present invention was made, it was not obvious to those of ordinary skill in the pertinent art how the identified needs could be fulfilled.

SUMMARY OF INVENTION

The long-standing but heretofore unfulfilled need for a golf club carrier of light-in-weight construction having a versatile stand means is now met by a new, useful, and nonobvious invention. The novel golf club carrier includes a central support member of elongate, straight, and rigid construction. A leg means having a bend formed mid-length thereof is formed of a flexible and resilient material such as a metal or a high-impact plastic. A pair of leg members, formed integrally with the bend, extend from opposite ends of the bend in diverging relation to one another when the leg means is in repose. A pivotal connection means pivotally connects the leg means to said central support member near a first, upper end of the central support member. The pivotal connection means that pivotally connects the leg means to the central support member is positioned at the bight of the bend formed in the leg means. The pivotal connection means is secured in position by a segment of adhesive-lined, heat shrink tubing.

A detent means is mounted in perpendicular relation to the central support member and is adapted to hold the leg members of the pair of leg members in substantially parallel relation to one another. The leg members are inherently biased to diverge from one another when retained within the detent means.

Each leg member of the pair of leg members has a length approximately equal to a length of the central support member. Accordingly, a three point support or tripod means is formed by a second, lower end of the central support member and by respective free ends of the leg members when said leg members are in repose and when said leg members are at least slightly pivoted with respect to the central support member.

An important object of this invention is to provide a golf club holder capable of carrying seven or fewer clubs.

Another important object is to provide such golf club holder in a construction that is very light-in-weight to encourage more golfers to walk during a round of golf.

Still another object is to provide a golf club carrying structure having a tripod stand with an infinite plurality of positions of adjustment.

Another object is to provide a versatile stand means that works in all soil and terrain conditions encountered in golf courses.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
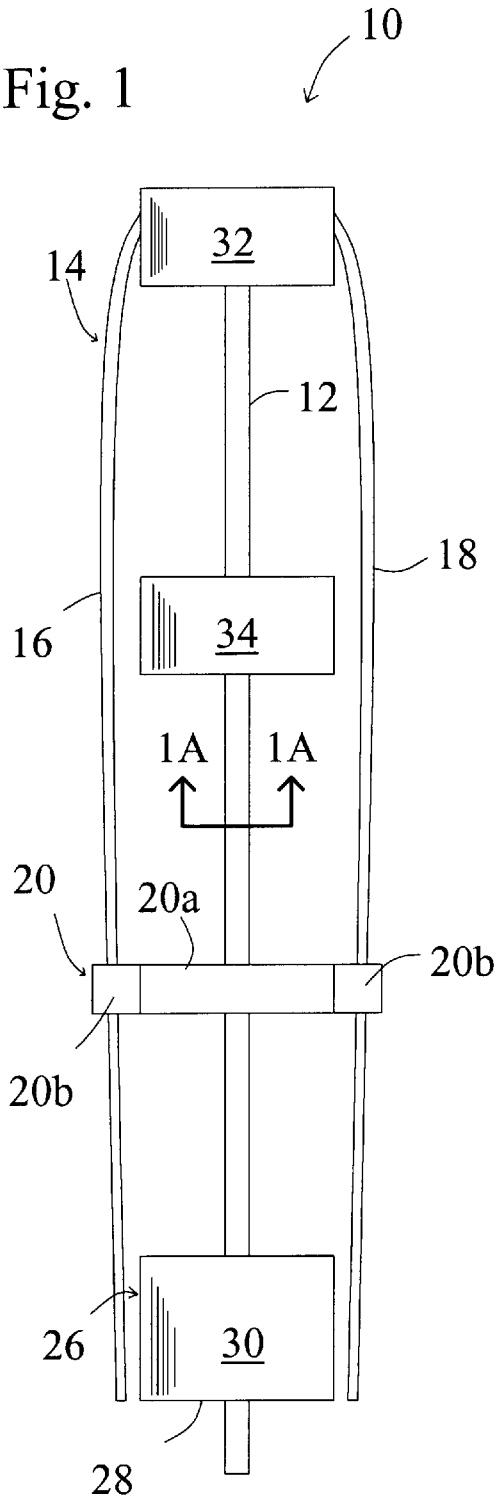
FIG. 1 is a front elevational view of a preferred embodiment of the invention when the stand means is in its stored configuration.

Referring to the front elevational view of FIG. 1, it will there be seen that the reference numeral 10 denotes an illustrative embodiment of the invention as a whole.

Novel light weight golf club carrier 10, to be known commercially as the Golf-D'Lite™, has a weight of less than two and one-half pounds.

Figure 1A:
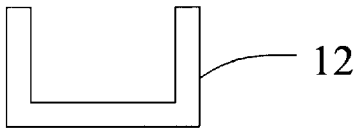
FIG. 1A is a sectional view taken along line 1A—1A in FIG. 1.

A central rigid support member 12 of straight configuration, preferably formed of an aluminum channel (see FIG. 1A) for purposes of weight, strength, corrosion resistance, durability, and aesthetics, provides one of the three legs that supports unit 10 when it is in use.

Figure 2:
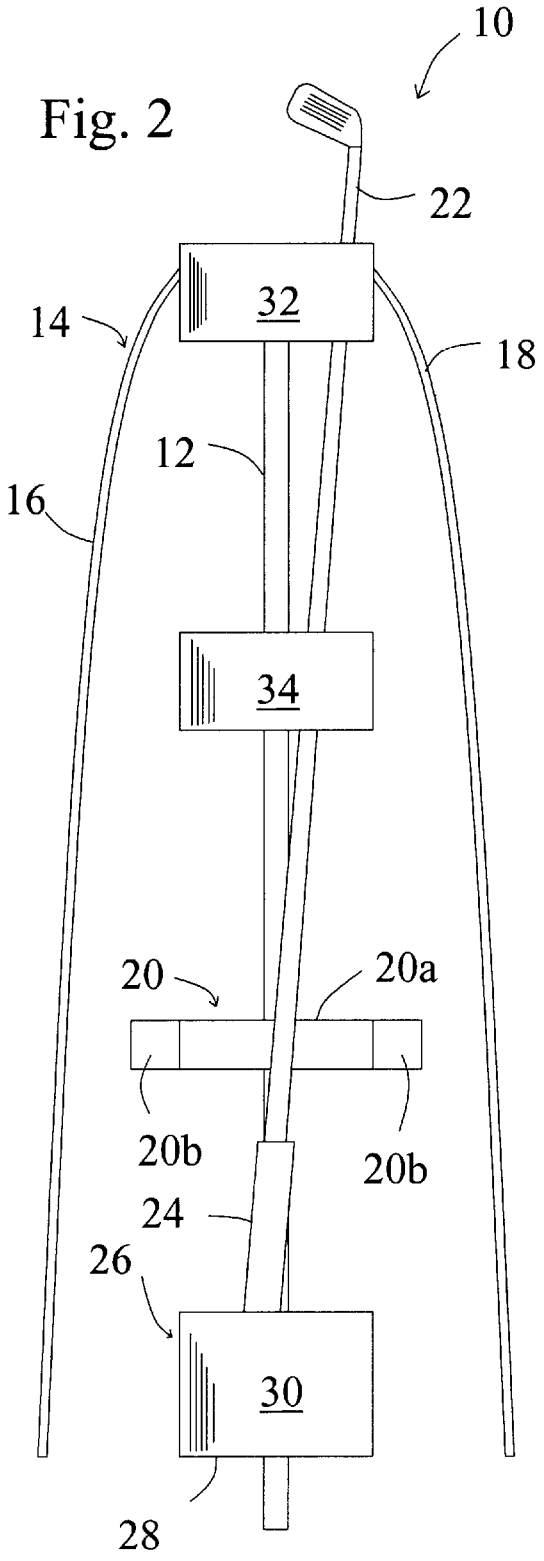
FIG. 2 is a front elevational view similar to the view of FIG. 1 but with the stand means depicted in its operative, deployed configuration.
Figure 3:
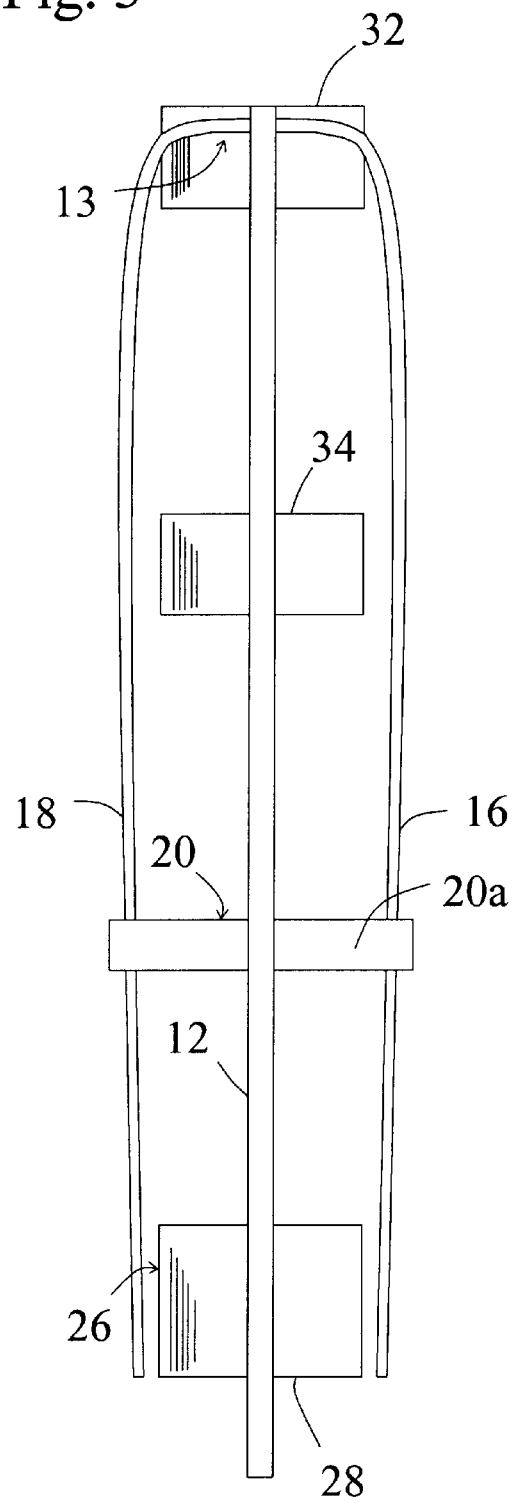
FIG. 3 is a rear elevational view of the invention when in its FIG. 1 configuration.

The second and third legs of carrier 10 are provided by an elongate rod 14 that is bent mid-length thereof as may best be understood in connection with FIGS. 2 and 3. Elongate rod 14 is made of a flexible and resilient light-in-weight metal, plastic, or other suitable material.

As perhaps best understood in connection with FIG. 3, rod 14 is of unitary construction. Thus, it should be understood that legs 16 and 18 are formed integrally with one another, and that said legs 16 and 18, together with central support member 12, provide the three point support for the novel carrier.

FIG. 2 depicts rod 14 when in repose and FIG. 1 depicts rod 14 when it is retained by detent means 20. When rod 14 is not retained by detent means 20, the inherent bias of rod 14 positions legs 16 and 18 in the FIG. 2 position, i.e., when no external forces are applied to rod 14, it assumes the FIG. 2 position where legs 16 and 18 are positioned in diverging relation to one another.

When legs 16 and 18 are manually converged toward one another, they may be captured by detent means 20 in the manner depicted in FIGS. 1 (front view) and 3 (rear view). When so captured, and as best understood in connection with FIG. 4, legs 16 and 18 do not cooperate with central support member 12 to hold carrier 10 upright.

Figure 5:
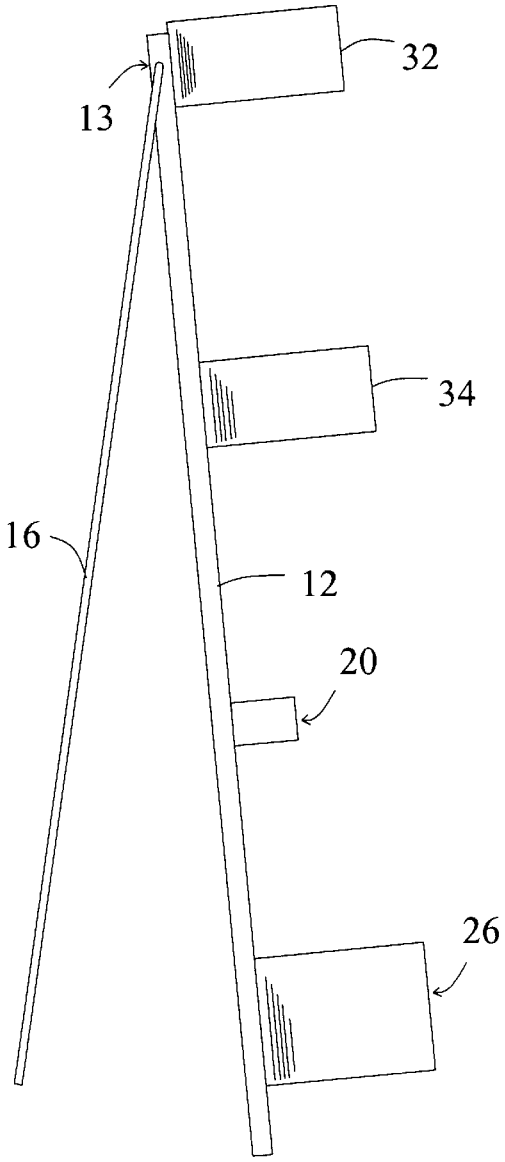
FIG. 5 is a side elevational view when the stand means is deployed in a first pivotal relation to the central support member.
Figure 6:
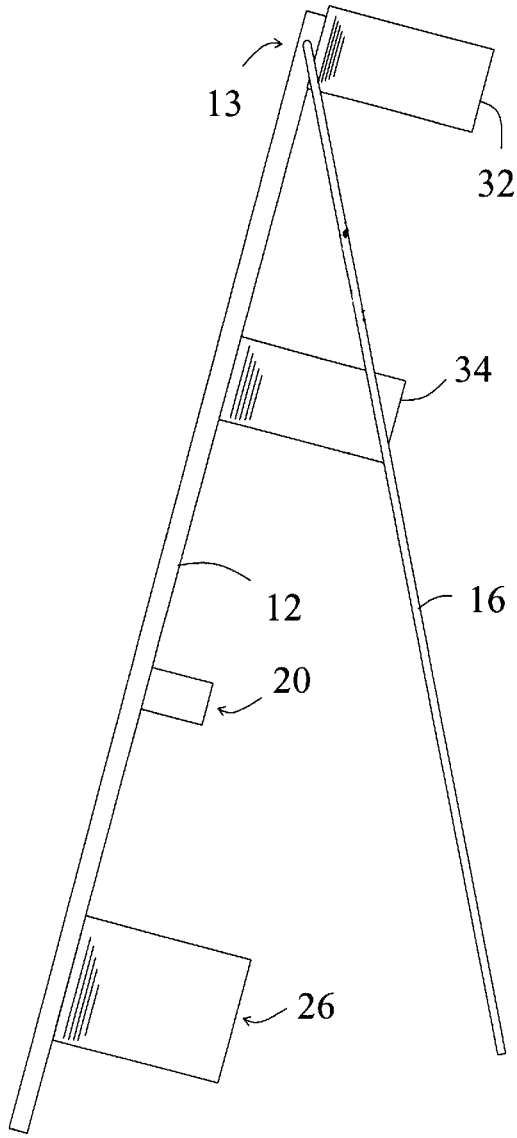
FIG. 6 is a side elevational view when the stand means is deployed in a second (preferred) pivotal relation to the central support member.

As best understood in connection with FIGS. 5 and 6, when legs 16, 18 are not retained by detent means 20, and when they are at least pivoted slightly with respect to central support member 12, they cooperate with central support member 12 to support carrier 10 so that it may rest atop a support surface in a stable, balanced configuration.

In FIG. 5, central support member 12 is leaning backward a preselected degree from the vertical and in FIG. 6, central support member 12 is leaning forward a preselected degree from the vertical. This is made possible by a pivotal connection between rod 14 and central support member 12.

As best understood in connection with FIG. 3, central support member 12 is apertured near its upper end and rod 14 extends therethrough as at 13. The diameter of the aperture (there being two aligned apertures in the preferred embodiment, due to the channel structure of central support member 12) is slightly greater than the diameter of rod 14 so that said rod 14 is free to pivot about the horizontal axis defined by said aperture. Rod 14 is held securely in place by a segment of adhesive lined heat shrink tubing.

It should therefore be understood that rod 14 and hence legs 16, 18 are free to rotate three hundred sixty degrees (360°) about the horizontal axis created by the aperture formed at the upper end of central support member 12. However, when carrier 10 is in use it will normally be tilted just slightly backwardly or forwardly relative to the vertical as depicted in FIGS. 5 and 6.

FIG. 2 shows a golf club 22 being carried within carrier 10. Five to seven clubs are accommodated by carrier 10.

Handle 24 of club 22 is supported by cup 26 as depicted in said FIG. 2. Cup 26 has an imperforate or substantially imperforate bottom wall 28 and upstanding sidewalls 30 mounted about the periphery thereof. Bottom wall 28 may be flat or dome-shaped.

The clubhead end of golf club 22 is supported by top ring member 32 (FIG. 2) that includes cylindrical sidewalls but no top or bottom, i.e., ring member 32 is of cylindrical construction.

Intermediate guide ring 34 has substantially the same construction as top ring member 32. To position a club in the manner depicted in FIG. 2, handle 24 is inserted sequentially through top ring member 32, intermediate guide ring member 34, and brought to rest atop bottom wall 28 of cup 26. Intermediate guide ring 34 may be eliminated to lighten carrier 10 even more because top ring 32 and cup 26 provide all needed support for club 22.

Figure 4:
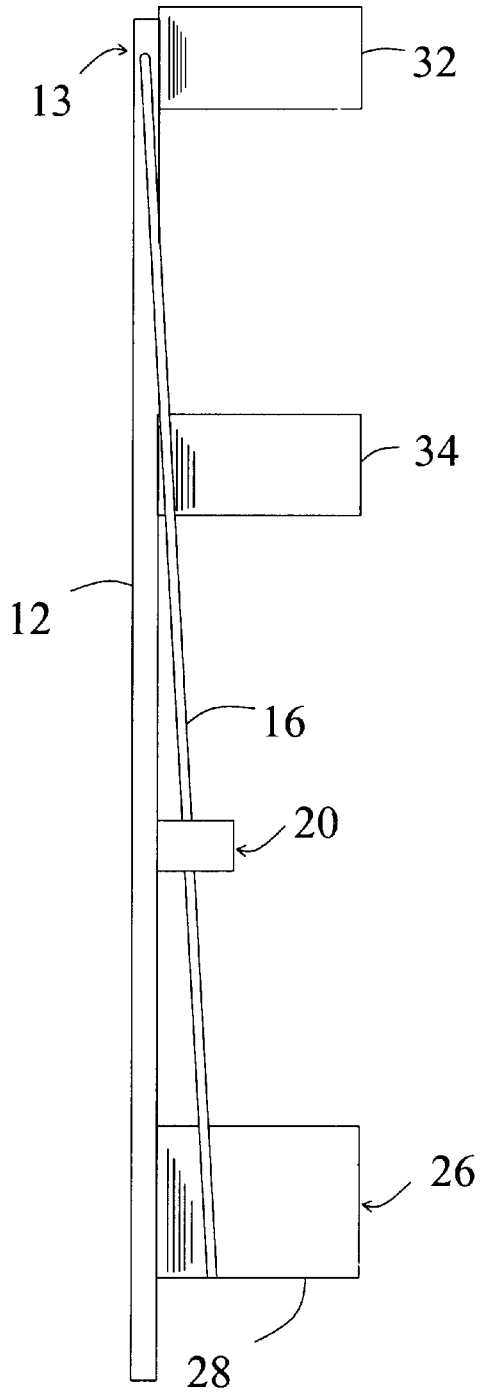
FIG. 4 is a side elevational view thereof when in its FIG. 1 configuration.

Note from FIGS. 4–6 that top ring 32, intermediate guide ring 34, detent means 20, and cup 26 are all mounted to central support member 12 on a common side thereof. The mounting may be accomplished by any suitable means such as nuts and bolts or the like.

Figure 7:
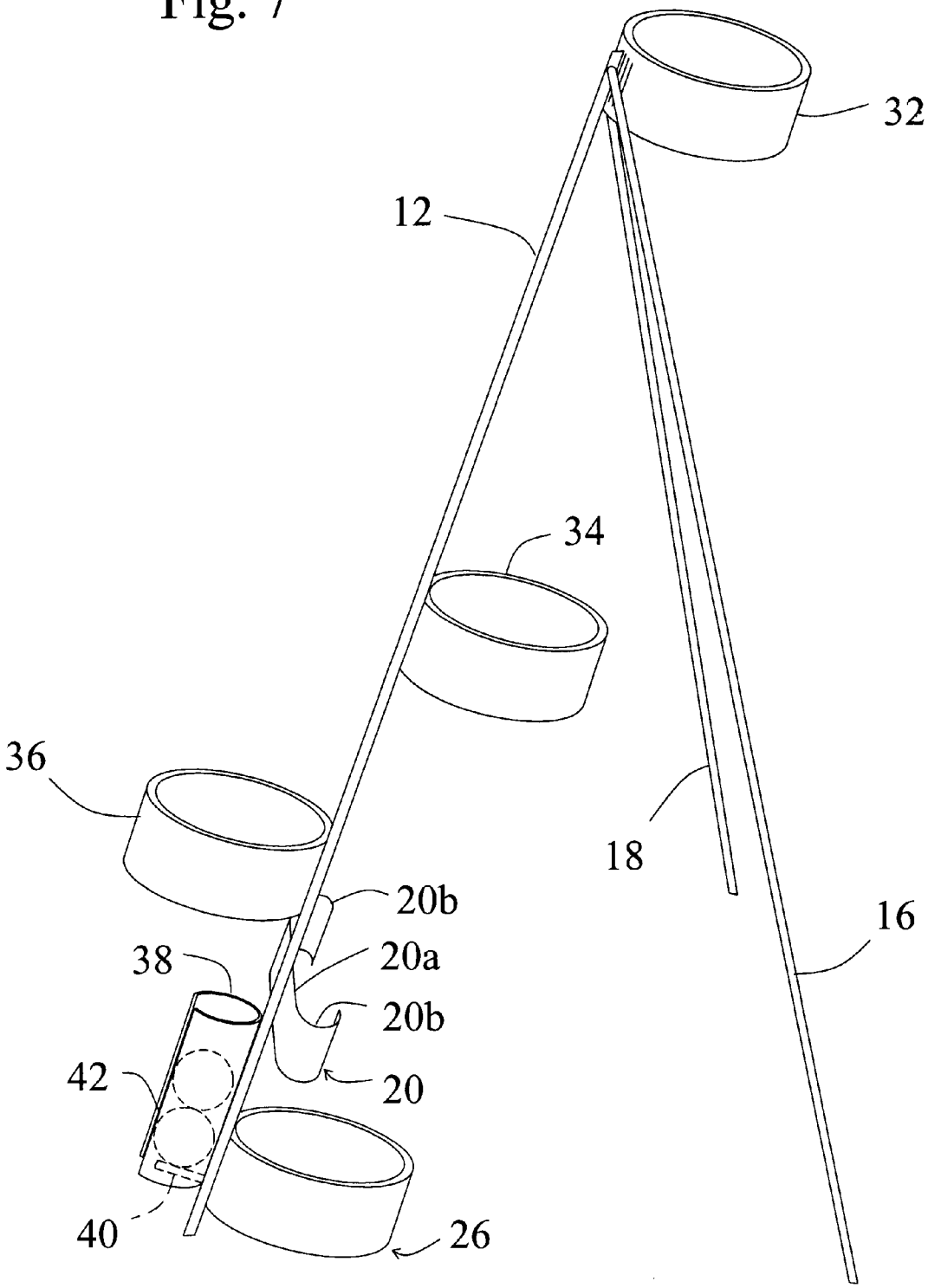
FIG. 7 is a perspective view of a preferred embodiment when the stand means is operatively deployed.

However, as indicated in FIG. 7, central support member 12 may serve as a mounting means for additional elements as well. Beverage can-holding ring 36 is of cylindrical construction and may be used to hold a beverage can as its name implies or it may be used to hold other items of similar size and shape. Note that it is mounted on the rearward side of carrier 10 so that it does not interfere with club-holding members 32, 34, and 26 mounted on the forward side of said carrier.

Moreover, a plurality of golf balls may be held in container 38 which is also mounted to the rearward side of central support member 12 in downwardly spaced relation to beverage can-holding ring 36. Note that container 38 also serves as a floor or stop means for any beverage can held in beverage can-holding ring 36.

Container 38 may have a bottom wall to support the golf balls stacked within it or said balls may be retained by a screw 40 that is secured to central support member 12 by a suitable nut means, for example, and which projects from said central support member 12 a distance sufficient to block egress of said balls from container 38 as depicted in said FIG. 7.

Container 38, in a preferred embodiment, has a finger-receiving slot 42 formed therein that extends along its entire extent. Thus, container 38 has a "C"-shaped transverse cross-section. Slot 42 facilitates removal of the balls from container 38 by one finger.

The structure of detent means 20 is also perhaps best understood in connection with FIG. 7. Detent means 20 has a straight back part 20*a* that is secured to central support member 12 by a nut and bolt or other suitable fastener means. Straight back 20*a* is positioned at a right angle to central support member 12. A return bend 20*b* is formed in each end of detent means 20 as best depicted in FIG. 7 to capture legs 16, 18 when they are manually brought toward one another as mentioned above.

There are a number of additional features that may be added to carrier 10. For example, a lanyard hook, not shown, or other fastening means may be secured to the upper end of central support member 12 by any suitable means, and a towel, not shown, may then be hung from said lanyard hook. Moreover, a cylindrical handle, not depicted, perhaps fashioned from a short length of PVC piping, or other suitable material, may be secured to central support member 12 at a preselected location thereon between upper ring 32 and intermediate guide ring 34. Such a handle provides a smooth cylindrical handle for the carrying of carrier 10. However, it may also be carried by simply grasping central support member 12 between said top ring and said intermediate guide ring.

In another unillustrated embodiment, top ring 32, intermediate guide ring 34, and cup 26 are merged together in one elongate cylinder that extends from said upper ring 32 to said cup 36. The cylinder has a closed bottom like that of cup 26 and functions in the same way as said upper ring and intermediate guide ring and said cup. However, such a cylindrical club holder increases the weight of carrier 10 and is more difficult to keep clean. Accordingly, the open structure depicted in the drawings is the preferred embodiment of the invention.

Where soil conditions are not a limiting factor, a rotating spike stand, not shown, and foot rest to facilitate driving the stand into the soil, not shown, may also be affixed to the lower end of central support member 12. Such structure represents an alternative stand means to the depicted tripod stand arrangement; it does not depend upon ground penetration.

A tee holding means, not shown, may also be provided. Such a tee-holding means may be provided in the form of a perforated lid that closes golf-ball container 38. An individual golf tee may then be inserted into each perforation. The golf tees or the perforated lid may support a beverage can disposed within beverage can-holding ring 36.

The depicted embodiment thus should be understood as a simplified embodiment of the invention in that it does not includes a towel-holding means, a specific handle, a closed cylinder for holding the clubs, a tee-holding lid for golf ball container 38, or a rotating spike stand and foot rest associated therewith. These unillustrated embodiments are within the scope of the claims that follow because they are embellishments of the novel structure.

Carrier 10, due to its three point stance when legs 16, 18 are deployed, may be positioned almost anywhere. Legs 16, 18 may be deployed to hold central support member 12 substantially vertical on hillsides or other sloped surfaces. Legs 16, 18 do not penetrate the surface of the earth, so carrier 10 may be positioned on very rocky soil as well. Most importantly, the very light-in-weight structure of carrier 10 encourages golfers to walk rather to ride so that the health benefits of the game may be realized.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described.

What is claimed is:

1. A golf club carrier, comprising:

a central support member of elongate, straight, and rigid construction;

said central support member being a channel member;

a leg means having a bend formed mid-length thereof, said leg means being formed of a flexible and resilient material;

a pair of leg members, formed integrally with said bend, that extend from opposite ends of said bend in diverging relation to one another when in repose;

a pivotal connection means for pivotally connecting said leg means to said channel member near a first, upper end of said channel member;

said pivotal connection means including a pair of aligned apertures adapted to receive said leg means at said bend, said aligned apertures being formed in opposing sidewalls of said channel member;

said pivotal connection means pivotally connecting said leg means to said channel member at said bend formed in said leg means;

each leg member of said pair of leg members having a length approximately equal to a length of said channel member;

a three point support means being formed by a second, lower end of said channel member and by respective free ends of said leg members when said leg members are in repose and when said leg members are at least slightly pivoted with respect to said channel member;

said channel member being tilted from a vertical plane in a first direction when said leg members are in repose and positioned on a first side of said channel member and said channel member being tilted from a vertical plane in a second direction when said leg members are in repose and positioned on a second side of said channel member;

a top ring secured to a first side of said channel member near said first, upper end and a cup member secured to said first side of said channel member near said second, lower end, said top ring and said cup member cooperating with one another to hold at least one golf club;

said top ring and cup member cooperating with one another to retain said at least one golf club when said channel member is tilted in said first direction and when said channel member is tilted in said second direction.

2. The golf club carrier of claim 1, further comprising:

a detent means mounted to said channel member;

said detent means adapted to hold the leg members of said pair of leg members in substantially parallel relation to one another, said leg members being inherently biased to diverge from on another when retained within said detent means;

said detent means including a detent member having a straight part secured to said channel member in perpendicular relation to said channel member, and wherein a return bend is formed on each end of said straight part so that said leg members may be positioned in captured relation between said return bends.

3. The golf club carrier of claim 1, further comprising an intermediate guide ring secured to said first side of said channel member, said intermediate guide ring being positioned at a preselected point between said top ring and said cup member and cooperating with the top ring and cup member as a guide to hold at least one golf club.

4. The golf club carrier of claim 3, further comprising a beverage can-holding ring secured to a second side of said channel member in non-interfering relation to said golf club-holding top ring, intermediate guide ring, and cup member.

5. The golf club carrier of claim 3, further comprising an elongate, "C"-shaped container for golf balls secured to said second side of said channel member.

6. The golf club carrier of claim 5, further comprising a screw means secured to said channel member that provides a support means for golf balls positioned within said "C"-shaped container.

7. A golf club carrier, comprising:

a central support member of elongate, straight, and rigid construction;

a leg means having a bend formed mid-length thereof, said leg means being formed of a flexible and resilient material;

a pair of leg members, formed integrally with said bend, that extend from opposite ends of said bend in diverging relation to one another when in repose;

a pivotal connection means for pivotally connecting said leg means to said central support member nears a first, upper end of said central support member;

said pivotal connection means pivotally connecting said leg means to said central support member at said bend formed in said leg means;

a detent member mounted to said central support member;

said detent member having a straight part secured to said central support member in perpendicular relation to said central support member, and a return bend being formed on each end of said straight part so that said leg members may be positioned in captured relation between said return bends;

said detent means adapted to hold the leg members of said pair of leg members in substantially parallel relation to one another, said leg members being inherently biased to diverge from one another when retained within said detent means;

each leg member of said pair of leg members having a length approximately equal to a length of said central support member;

a three point support means being formed by a second, lower end of said central support member and by respective free ends of said leg members when said leg members are in repose and when said leg members are at least slightly pivoted with respect to said central support member;

said central support member being tilted from a vertical plane in a first direction when said leg members are in repose and positioned on a first side of said central support member and said central support member being tilted from a vertical plane in second direction when said leg members are in repose and positioned on a second side of said central support member;

a top ring secured to a first side of said central support member near said first, upper end and a cup member secured to said first side of said central support member near said second, lower end, said top ring and said cup member cooperating with one another to hold at least one golf club; and a beverage can-holding ring secured to a second side of said central support member in non-interfering relation to said top ring and cup member.

8. The golf club carrier of claim 7, further comprising an intermediate guide ring secured to said first side of said central support member, said intermediate guide ring being positioned at a preselected point between said top ring and said cup member and cooperating with the top ring and cup member as a guide to hold at least one golf club.

9. The golf club carrier of claim 7, further comprising an elongate, "C"-shaped container for golf balls secured to said second side of said central support member.

10. The golf club carrier of claim 9, further comprising a screw means secured to said central support member that provides a support means for golf balls positioned within said "C"-shaped container.

11. A golf club carrier, comprising:

a central support member of elongate, straight, and rigid construction;

a leg means having a bend formed mid-length thereof, said leg means being formed of a flexible and resilient material;

a pair of leg members, formed integrally with said bend, that extend from opposite ends of said bend in diverging relation to one another when in repose;

a pivotal connection means for pivotally connecting said leg means to said central support member near a first, upper end of said central support member;

said pivotal connection means pivotally connecting said leg means to said central support member at said bend formed in said leg means;

said central support member being a channel member and said pivotal connections means including a pair of aligned apertures adapted to receive said leg means at said bend, said aligned apertures being formed in opposing sidewalls of said channel member;

a top ring secured to a first side of said channel member near said first, upper end and a cup member secured to said first side of said channel member near said second, lower end, said top ring and said cup member cooperating with one another to hold at least one golf club;

a detent means mounted to said channel member;

said detent means adapted to hold the leg members of said pair of leg members in substantially parallel relation to one another; said leg members being inherently biased to diverge from one another when retained within said detent means;

a three point support means being formed by a second, lower end of said channel member and by respective free ends of said leg members when said leg members are in repose and when said leg members are at least slightly pivoted with respect to said channel member;

said channel member being tilted from a vertical plane in a first direction when said leg members are in repose and positioned on a first side of said channel member and said channel member being tilted from a vertical plane in a second direction when said leg members are in repose and positioned on a second side of said channel member; and said top ring and cup member cooperating with one another to retain said at least one golf club when said channel member is tilted in said first direction and when said channel member is tilted in said second direction.

12. The golf club carrier of claim 11, further comprising an intermediate guide ring secured to said first side of said channel member, said intermediate guide ring being positioned at a preselected point between said top ring and said cup member and cooperating with the top ring and cup member as a guide to hold at least one golf club.

13. The golf club carrier of claim 12, further comprising a beverage can-holding ring secured to a second side of said channel member in non-interfering relation to said golf club-holding top ring, intermediate guide ring, and cup member.

14. The golf club carrier of claim 13, further comprising an elongate, "C"-shaped container for golf balls secured to said second side of said channel member.

15. The golf club carrier of claim 14, further comprising a screw means secured to said channel member that provides a support means for golf balls positioned within said "C"-shaped container.

16. The golf club container of claim 11, wherein said leg means is an elongate metal rod.

* * * * *